US006093685A

United States Patent [19]

Wood, Sr.

[11] Patent Number: 6,093,685

[45] Date of Patent: Jul. 25, 2000

[54] FORMULA FOR ARROW LUBRICATION

[76] Inventor: Gary L. Wood, Sr., Box 106, North Granville, N.Y. 12854

[21] Appl. No.: 09/306,715

[22] Filed: May 7, 1999

Related U.S. Application Data

[60] Provisional application No. 60/084,736, May 8, 1998.

[51] Int. Cl.[7] ..... C10M 139/00

[52] U.S. Cl. ..... 508/203; 508/207; 508/208

[58] Field of Search ..... 508/203, 207, 508/208

[56] References Cited

U.S. PATENT DOCUMENTS

| | | | |
|---|---|---|---|
| D. 379,033 | 5/1997 | Coffey et al. | D3/221 |
| 4,253,981 | 3/1981 | Ayers | 508/203 |
| 4,806,430 | 2/1989 | Spielvogel et al. | 428/450 |
| 5,293,960 | 3/1994 | Majerowicz et al. | 184/13.1 |
| 5,445,243 | 8/1995 | Coffey et al. | 184/102 |
| 5,456,948 | 10/1995 | Mathisen et al. | 427/387 |
| 5,534,173 | 7/1996 | Faber et al. | 508/203 |
| 5,564,527 | 10/1996 | Coffey et al. | 184/102 |

*Primary Examiner*—Margaret Medley
*Assistant Examiner*—Cephia D. Toomer
*Attorney, Agent, or Firm*—Richard C. Litman

[57] ABSTRACT

The invention is a lubricant intended primarily to facilitate removal of arrows from targets after shooting. The lubricant consists of approximately 70% silicone lubricant and 30% hexane. The lubricant is preferably applied using an applicator, which could be an elongated housing with a threaded hole in each end, having a threaded plug for each hole, the applicator having absorbent material holding the lubricant. Immediately before shooting, the archer removes one or both plugs, and thrusts the arrow into the absorbent material to the desired depth, so that the point and shaft of the arrow receive the lubricant. The arrow can then be easily removed from its target after shooting. A container with a dauber for dispensing lubricant can be provided, alternatively.

1 Claim, 2 Drawing Sheets

FORMULA FOR ARROW LUBRICATION

CROSS REFERENCE TO RELATED APPLICATIONS

This application claims the benefit of U.S. Provisional Application Ser. No. 60/084,736 filed May 8, 1998.

BACKGROUND OF THE INVENTION

1. Field of the Invention

The present invention relates to a sport arrow lubrication. Specifically, the invention is a mixture of a silicone lubricant and a hydrocarbon liquid such as hexane or kerosene.

2. Description of the Related Art

Other inventors have devised silicone lubricants and various hydrocarbon additives to improve the effectiveness of such lubricants. Additionally, other inventors have patented applicators for lubricating the tips of arrows. However, none of the prior patents following teaches the use of the arrowhead lubricant of the present invention.

An early example of a silicon lubricant is U.S. Pat. No. 4,253,981, issued to Peter J. Ayres, describing a mixture of diisopropyl adipate, purcellin oil, glycerol tribehenate, silicone oil, a surfactant, sorbitan monocleate, and sorbitan trioleate.

U.S. Pat. No. 4,806,430, issued to David E. Spielvogel, describes a silicone composition used for lubrication. The lubricant comprises a reactive portion which adheres to the substrate and forms a matrix for the nonreactive portion, and a nonreactive portion providing the lubricating qualities.

U.S. Pat. No. 5,456,948, issued to Todd R. Mathisen, et al., describes a lubricant comprising a nonflammable highly fluorinated organic compound, a silicone lubricant, and a fluorine-free solvent such as hexane wherein the silicone lubricant is soluble.

U.S. Pat. No. 5,534,173, issued to Robert D. Faber, et al., describes a lubricant comprising a hydrocarbon solvent (preferably mineral spirits), silicone (preferably Dow Corning 245 fluid or 345 fluid), and a lubricating oil (preferably with the formula $C_nH_{2n+2}$; mineral oil, Penreco Corp. PAROL 70, or Witco Chemical Co. SEMTOL 70 are suggested). The addition of the hydrocarbon to the silicone is claimed to enhance penetration and spreadability.

Applicators for lubricants are also known. U.S. Pat. No. 5,293,960, issued to Frank G. Majerowicz, describes a lubricating apparatus wherein a suction-type applicator picks up a silicone lubricant stored in a foam material, and is then used to dispense the lubricant in an endoscope. Additionally, U.S. Pat. No. 5,445,243, issued to B. Howard Coffey, describes a portable lubrication system comprising a casing having a lid with a septum-type cover, holding a fibrous or cellular material which has absorbed the lubricant, such as glycol or silicon. The arrow is inserted into the absorbent material to lubricate the tip immediately before shooting. Mr. Coffey's continuation-in-part, U.S. Pat. No. 5,564,527, describes a very similar concept. Mr. Coffey was also issued U.S. Design Pat. No. 379,033 for an ornamental design for his invention.

None of the above inventions and patents, taken either singly or in combination, is seen to describe the instant invention as claimed.

SUMMARY OF THE INVENTION

The current invention is a silicone lubricant for the point and shaft of an arrow, and a system for applying the lubricant.

The lubricant consists of approximately 70% by volume silicone lubricant and approximately 30% by volume hydrocarbon thinner, such as hexane or kerosene. The silicone lubricant contains, about 40% by weight hydroxy-terminated dimethyl siloxane, approximately 3% by weight methylhydrogen siloxane, and 1% by weight octamethyl cyclotetrasiloxane. The silicone lubricant also should contain approximately 54% by weight aliphatic solvents, preferably light aliphatic petroleum solvent naptha. A preferred silicone lubricant is marketed by Dow Corning under the trade name SYL-OFF 294. The hydrocarbon thinner makes the lubricant easier to apply to the arrowhead, and more effective for its intended purpose.

The applicator consists of a tube with a cap at each end, filled with foam or other absorbent material. Both end caps have threaded holes, slightly larger than the diameter of an arrow. Each threaded hole is closed with a threaded plug when the applicator is not in use. The foam absorbs the lubricant, holding it until needed. The arrow is lubricated immediately before being shot by first removing one or both threaded plugs, and then sticking the arrowhead through one or both holes, until it reaches a sufficient depth in the foam for proper lubrication. When shot at a target, the lubricant facilitates withdrawal of the arrow.

Accordingly, it is a principal object of the invention to provide an effective lubricant for removing arrows from targets.

It is another object of the invention to provide a quick method for removing arrows from targets, while also minimizing damage to the targets, during training or competition.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a silicone lubricant for the point and shaft of arrows. It consists of approximately 70% by volume silicone lubricant and 30% by volume hydrocarbon thinner. The silicone lubricant comprises, about 40% by weight hydroxy-terminated dimethyl siloxane, approximately 3% by weight methylhydrogen siloxane, approximately 1% by weight octamethyl cyclotetrasiloxane, and approximately 54% by weight aliphatic solvent. A preferred silicon lubricant is marketed by Dow Corning under the trade name SYL-OFF 294. Hexane is a preferred hydrocarbon thinner, but kerosene can be used. The hydrocarbon thinner makes the lubricant easier to apply to an arrow, and also increases the effectiveness of the lubricant for the purpose of removing arrows from targets.

Figure 1:
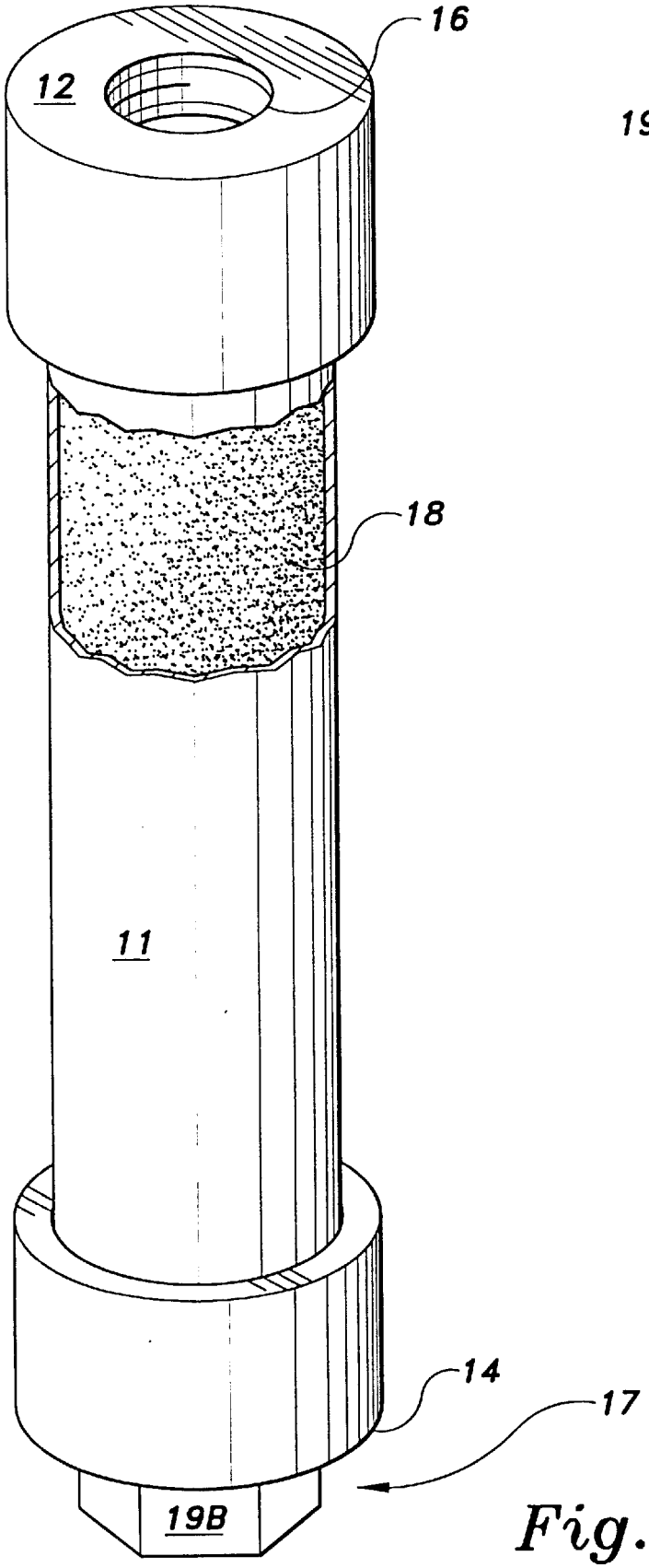
FIG. 1 is a cutaway perspective view of an arrow lubricant applicator according to the present invention, having one threaded plug in place on the end, and the other plug removed.
Figure 2:
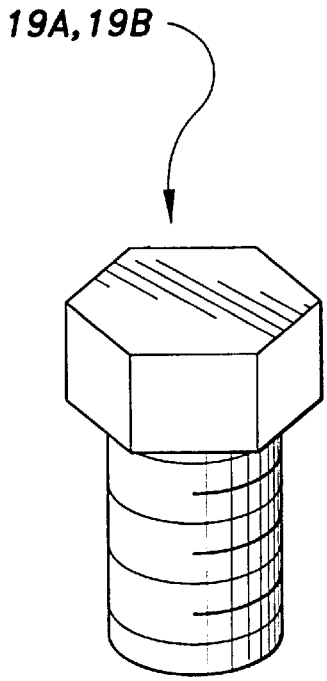
FIG. 2 is a perspective view of a threaded plug used with an arrow lubricant applicator.

The preferred method of applying the lubricant is using an applicator, one example of which is of a type shown in FIG. 1. The applicator 10 comprises a housing, 11, with two closed ends, a top end 12 and a bottom end 14. The top end 12 and bottom end 14 each include a hole, 16, 17 having a diameter slightly larger than that of an arrow. Although the invention can function with other dimensions, the preferred dimensions are 4 in. long×¾ in. dia., with holes 16, 17 having a diameter of ½ in. Ideally, the holes 16, 17 are threaded. When not in use, the holes are plugged using a threaded plug 19A, 19B, shown in FIG. 2.

Figure 3:
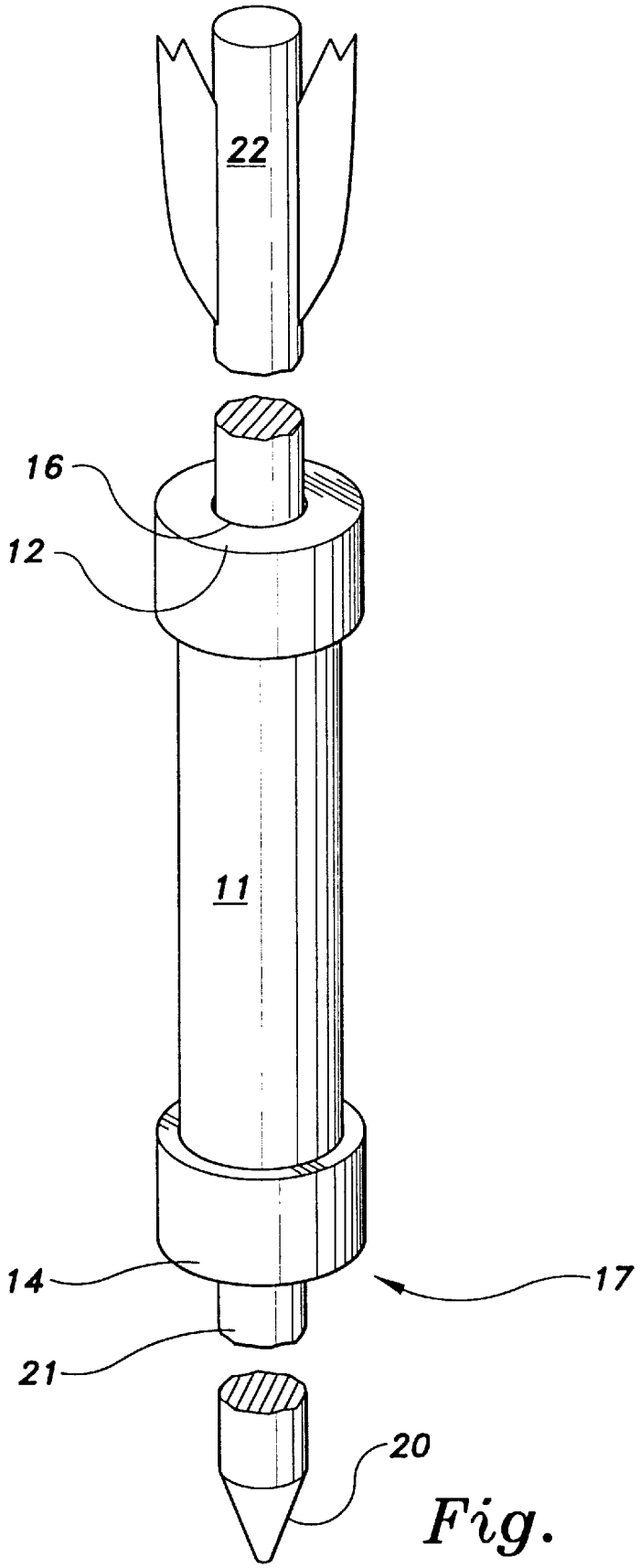
FIG. 3 is a perspective view of an arrow lubrication applicator in use.

Inside the housing, the lubricant is held by foam 18 or other absorbent material. FIG. 3 shows an arrow being lubricated before shooting. To lubricate an arrow, 22, one or both of the plugs 19A, 19B are first removed. Next, the arrowhead 20 is placed inside the hole 16 so that it penetrates the foam 18. The lubricant in the foam 18 sticks to the arrow. The archer can vary the length of shaft 21 receiving the lubricant by varying the distance he pushes the arrow 22 through the applicator. The arrow 22 is typically lubricated immediately before shooting, so that the lubricant facilitates removal of the arrow 22 from its target.

On the other hand, it is to be understood that most any type of applicator can be employed which will accomplish the intended task easily. I have found, as an additional example, that a dauber-type applicator works perfectly satisfactorily with the lubricant of this invention.

It is to be understood that the present invention is not limited to the embodiments described above, but encompasses any and all embodiments within the scope of the following claims.

I claim:

1. An arrow lubricant consisting of:

approximately 70% by volume silicone lubricant, said silicone lubricant containing about 40% by weight hydroxy-terminated dimethyl siloxane, approximately 3% by weight methylhydrogen siloxane, approximately 1% by weight octamethyl cyclotetrasiloxane, and approximately 54% by weight light aliphatic petroleum solvent naphtha; and approximately 30% by volume hydrocarbon thinner selected from the group consisting of hexane and kerosene.

* * * * *